US008277006B2

(12) United States Patent
Donahue et al.

(10) Patent No.: US 8,277,006 B2
(45) Date of Patent: Oct. 2, 2012

(54) CONTROLLABLE MAINTENANCE OPERATIONS FOR EFFICIENT INK USE

(75) Inventors: Frederick A. Donahue, Walworth, NY (US); Donald V. Brumbaugh, Hilton, NY (US); Gary A. Kneezel, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 262 days.

(21) Appl. No.: 12/711,354

(22) Filed: Feb. 24, 2010

(65) Prior Publication Data

US 2011/0205263 A1 Aug. 25, 2011

(51) Int. Cl.

| | |
|---|---|
| ***B41J 29/38*** | (2006.01) |
| ***B41J 29/293*** | (2006.01) |
| ***B41J 2/015*** | (2006.01) |
| ***B41J 2/165*** | (2006.01) |

(52) U.S. Cl. ..... 347/6; 347/19; 347/21; 347/31

(58) Field of Classification Search ..... None
See application file for complete search history.

(56) References Cited

U.S. PATENT DOCUMENTS

| | | | | |
|---|---|---|---|---|
| 5,404,158 | A | 4/1995 | Carlotta et al. | |
| 6,722,755 | B2 | 4/2004 | Shigeno | |
| 7,422,302 | B2 * | 9/2008 | Tanaka | 347/19 |
| 2007/0188542 | A1 * | 8/2007 | Kanfoush et al. | 347/21 |

* cited by examiner

*Primary Examiner* — Stephen Meier
*Assistant Examiner* — Alexander C Witkowski
(74) *Attorney, Agent, or Firm* — Peyton C. Watkins

(57) ABSTRACT

A method of controlling in a printer the maintenance of an inkjet printhead supplied with fluid from a plurality of fluid sources, the method includes the steps of (a) monitoring the usage of the plurality of fluid sources; (b) identifying a preferred fluid source for use in a maintenance operation based on the monitored usage of the plurality of fluid sources; and (c) performing the maintenance operation using a first quantity of fluid from the preferred fluid source.

24 Claims, 8 Drawing Sheets

CONTROLLABLE MAINTENANCE OPERATIONS FOR EFFICIENT INK USE

CROSS REFERENCE TO RELATED APPLICATIONS

Reference is made to commonly assigned U.S. patent application Ser. No. 12/711,367 filed Feb. 24, 2010 by Gary A. Kneezel, et al., entitled "Using Nondepleted Ink Source for Maintenance Operation", the disclosures of which are herein incorporated by reference.

FIELD OF THE INVENTION

The present invention relates generally to maintenance operations in an inkjet printer, and more particularly to controlling certain maintenance operations in a way that promotes efficient usage of ink.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and an orifice through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium, i.e., print medium, (also sometimes generically referred to as paper herein) in order to produce an image according to image data that is converted into electronic firing pulses for the drop ejectors as the print medium is moved relative to the printhead.

Motion of the print medium relative to the printhead may consist of keeping the printhead stationary and advancing the print medium past the printhead while the drops are ejected. This architecture is appropriate if the nozzle array on the printhead can address the entire region of interest across the width of the print medium. Such printheads are sometimes called pagewidth printheads.

A second type of printer architecture is the carriage printer, where the printhead nozzle array is somewhat smaller than the extent of the region of interest for printing on the print medium and the printhead is mounted on a carriage. In a carriage printer, the print medium is advanced a given distance along a print medium advance direction and then stopped. While the print medium is stopped, the printhead carriage is moved in a direction that is substantially perpendicular to the print medium advance direction as the drops are ejected from the nozzles. After the carriage has printed a swath of the image while traversing the print medium, the print medium is advanced; the carriage direction of motion is reversed; and the image is formed swath by swath.

Inkjet ink includes a variety of volatile and nonvolatile components including pigments or dyes, humectants, image durability enhancers, and carriers or solvents. A key consideration in ink formulation is the ability to produce high quality images on the print medium. During periods when ink is not being ejected from an ejector, the ink viscosity at the nozzle can change. For example, the volatile components of the ink can evaporate through the nozzle. Such changes can make the drop ejection process nonuniform, so that the image quality can be degraded. In addition, dust, dried ink or other particulates can partially block a nozzle or make the wettability of the nozzle face around the nozzle nonuniform so that ejected drops can be misdirected from their intended flight paths.

In order to maintain the drop ejecting quality of the printhead so that high quality images are produced even after periods where one or more nozzles have been inactive, a variety of maintenance actions has been developed and is well known in the art. These maintenance actions can include capping the printhead nozzle face region during periods of nonprinting, wiping the nozzle face, periodically spitting drops from the nozzles into the cap or other reservoir that is outside the printing region, priming the nozzles by applying a suction pressure at the nozzle face, and etc.

Although most maintenance operations are performed to maintain drop ejecting quality in a direct manner as described above, some maintenance operations are performed in an indirect manner. An example of such an indirect maintenance operation is disclosed in U.S. Pat. No. 5,404,158, where the printhead can eject ink into the cap for the purpose of increasing the humidity within the cap. Such a maintenance operation is herein termed an indirect operation because it is maintaining proper conditions within the cap so that the cap will be able to provide suitable surroundings for the printhead.

Maintenance operations use ink that would otherwise be available for printing. What is needed is a way to control maintenance operations, and more specifically a way to control indirect maintenance operations, such that ink is used more efficiently. More efficient ink usage makes it possible for the user to change ink supplies less frequently, which results in saving the user both effort and money, and also putting less waste into the environment.

SUMMARY OF THE INVENTION

The present invention is directed to overcoming one or more of the problems set forth above. Briefly summarized, according to one aspect of the invention, the invention resides a method of controlling in a printer the maintenance of an inkjet printhead supplied with fluid from a plurality of fluid sources, the method comprising the steps of (a) monitoring the usage of the plurality of fluid sources; (b) identifying a preferred fluid source for use in a maintenance operation based on the monitored usage of the plurality of fluid sources; and (c) performing the maintenance operation using a first quantity of fluid from the preferred fluid source.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

DETAILED DESCRIPTION OF THE INVENTION

Figure 1:
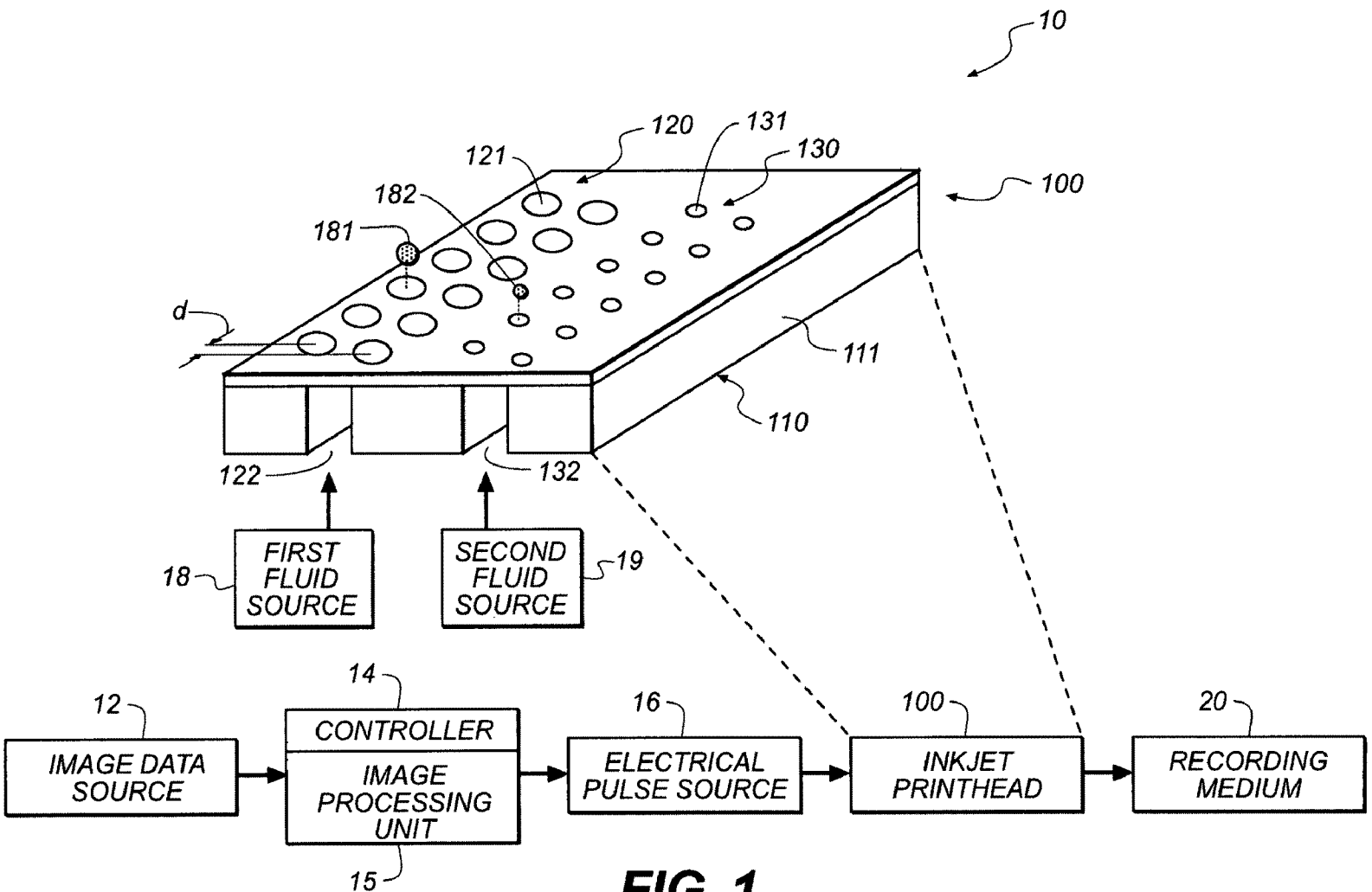
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit IS for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
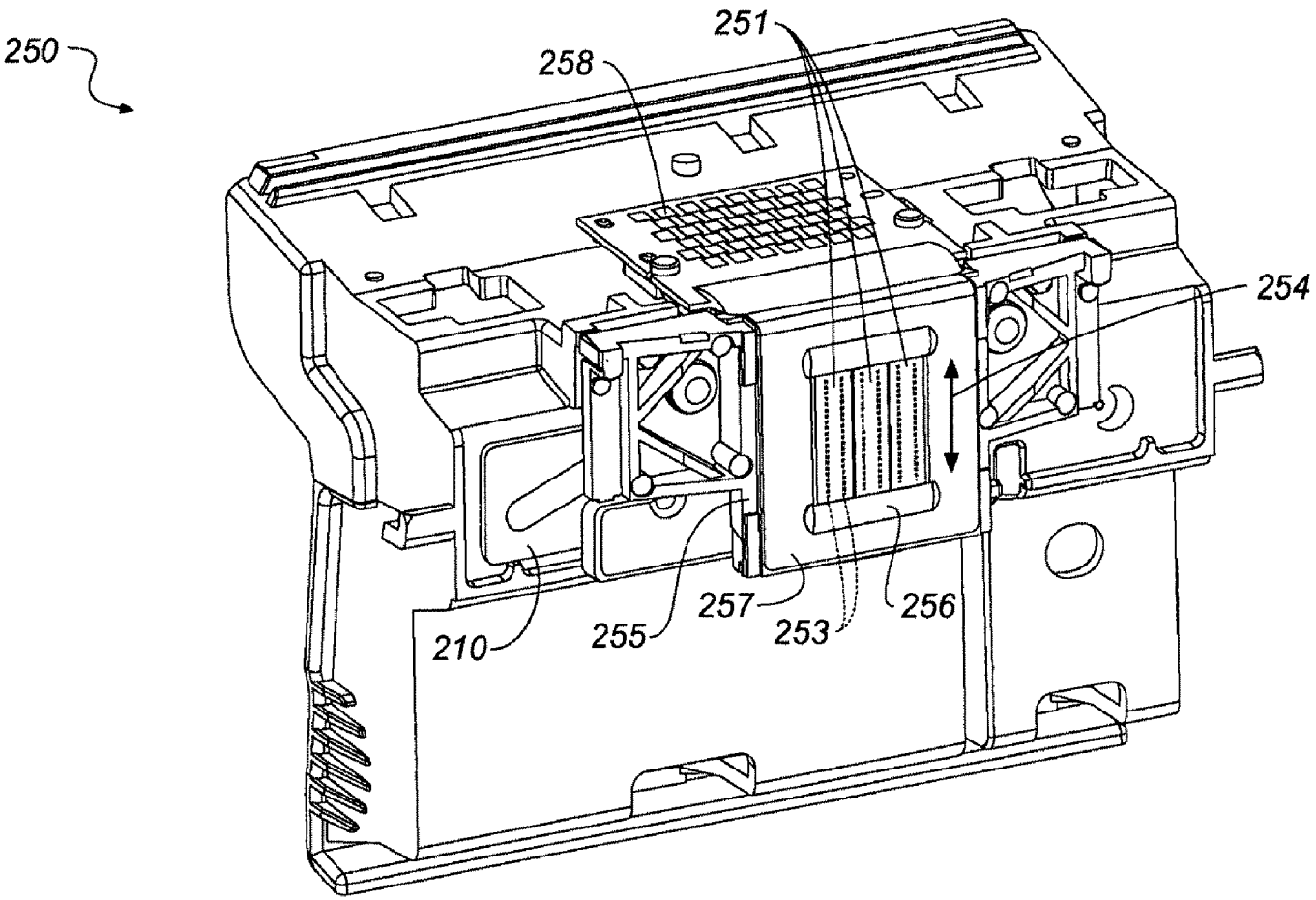
FIG. 2 is a perspective view of a portion of a printhead chassis.

FIG. 2 shows a perspective view of a portion of a printhead chassis 250, which is an example of an inkjet printhead 100. Printhead chassis 250 includes three printhead die 251 (similar to printhead die 110 in FIG. 1) mounted on mounting substrate 255, each printhead die 251 containing two nozzle arrays 253, so that printhead chassis 250 contains six nozzle arrays 253 altogether. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead chassis 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals can be transmitted to the printhead die 251.

Figure 3:
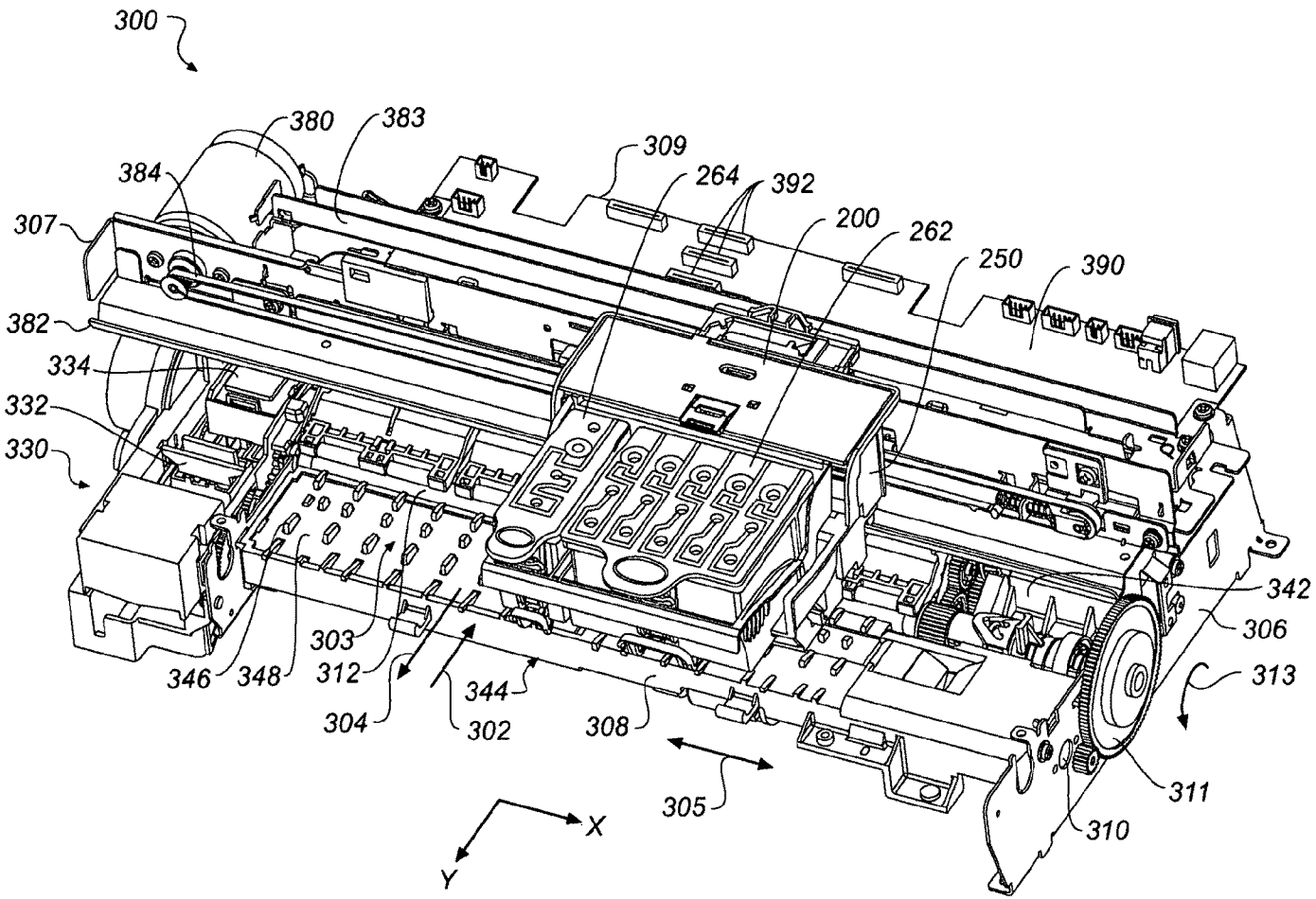
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 3) on printhead chassis 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead chassis 250 is mounted in carriage 200, and multi-chamber ink tank 262 and single-chamber ink tank 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording medium in print region 303 in the view of FIG. 3. Multi-chamber ink tank 262, in this example, contains five ink sources: cyan, magenta, yellow, photo black, and colorless protective fluid; while single-chamber ink tank 264 contains the ink source for text black. Paper or other recording medium (sometimes generically referred to as paper or media herein) is loaded along paper load entry direction 302 toward the front of printer chassis 308.

Figure 4:
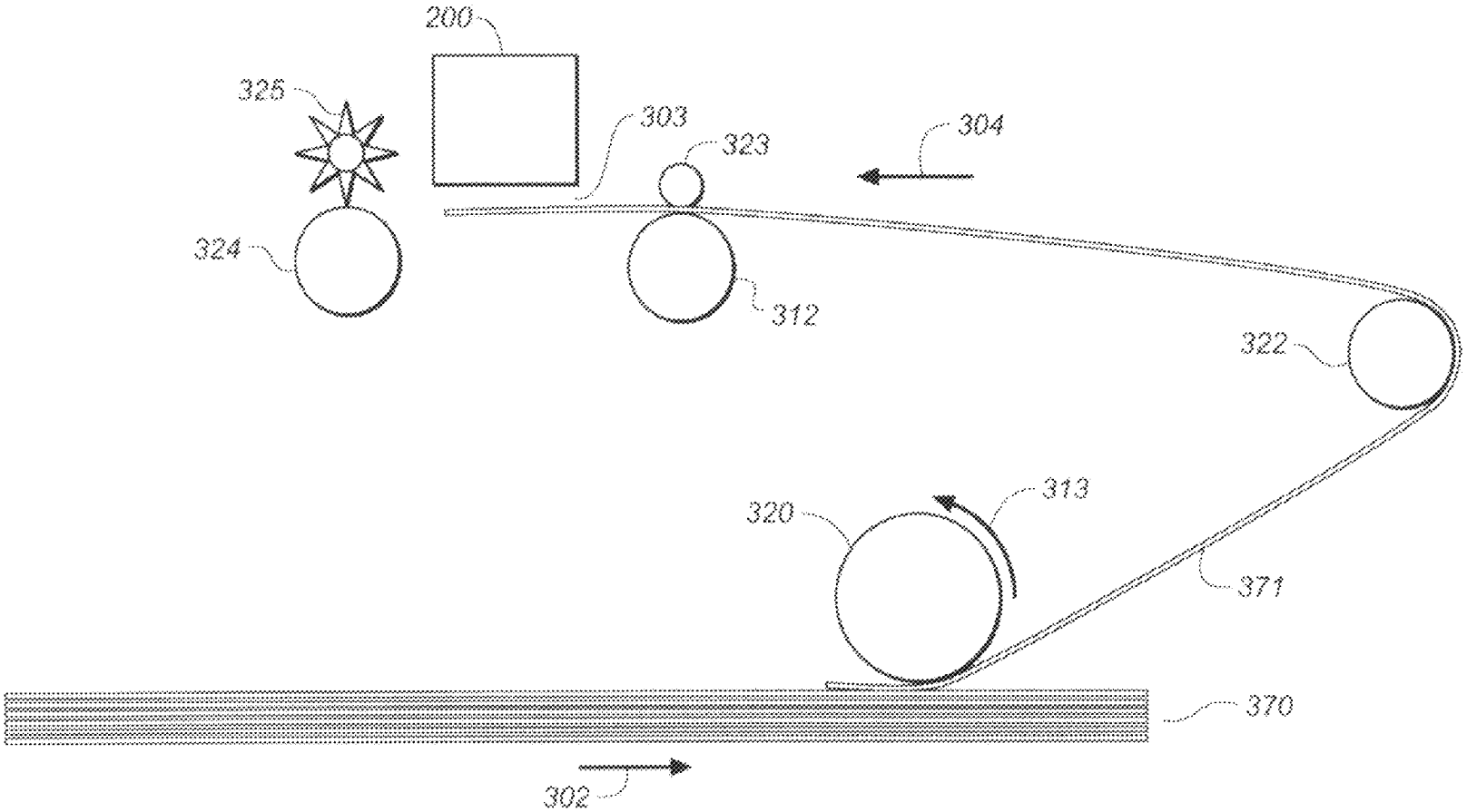
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to 25, advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330. Maintenance station 330 includes wiper 332 and cap 334. In order to maintain the drop ejecting quality of the printhead so that high quality images are produced even after periods where one or more nozzles has been inactive, a variety of maintenance actions have been developed and are well known in the art. These maintenance actions can include capping the printhead nozzle face region with cap 334 during periods of nonprinting, wiping the nozzle face with wiper 332, periodically ejecting drops from the nozzles into cap 334 or other reservoir that is outside the printing region, and priming the nozzles by applying a suction pressure at the nozzle face when the printhead is capped by cap 334.

Platen 344 supports the paper in the print region 303. In order to accommodate borderless printing of photographs, for example, where ink is deposited beyond the edges of the paper, platen 344 typically includes platen ribs 346 and platen absorber 348 surrounding platen ribs 346. The platen absorber 348 is an absorbent material that absorbs ink drops that are printed beyond the edges of the paper. Platen ribs 346 extend upward from platen absorber 348 and provide the surface upon which the paper is supported in print region 303. Platen ribs 346 are located in positions where it is unlikely that borderless printing will take place. For example, they are typically not located near where the edges of standard width paper would be located in print region 303. At the end of the print region 303 opposite maintenance station 330 is spittoon 342. Spittoon 342 is typically a recessed cavity leading to an absorbent material (not shown) where the printhead can eject maintenance drops without the carriage 200 needing to move back to the side of the printer including the maintenance station 330.

Toward the rear of the printer chassis 309, in this example, is located the electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process (including maintenance operations), and an optional connector for a cable to a host computer.

Embodiments of the present invention control maintenance operations, particularly maintenance operations that are not specific to a predetermined ink and its corresponding nozzle array, in such a way that ink is used more efficiently in the printer, and replacement of ink supplies thereby can be done less frequently. This is done by monitoring the ink usage so that the printer controller 14 has information regarding the amount of ink remaining in each of a plurality of different ink sources. A computer program that is typically stored in the printer and run by firmware in the printer controller 14 identifies a preferred fluid source to perform maintenance operations that are not specific to a predetermined ink and nozzle array. A preferred fluid source would be one of the ink sources, for example, having a comparatively larger amount of ink remaining.

Figure 5:
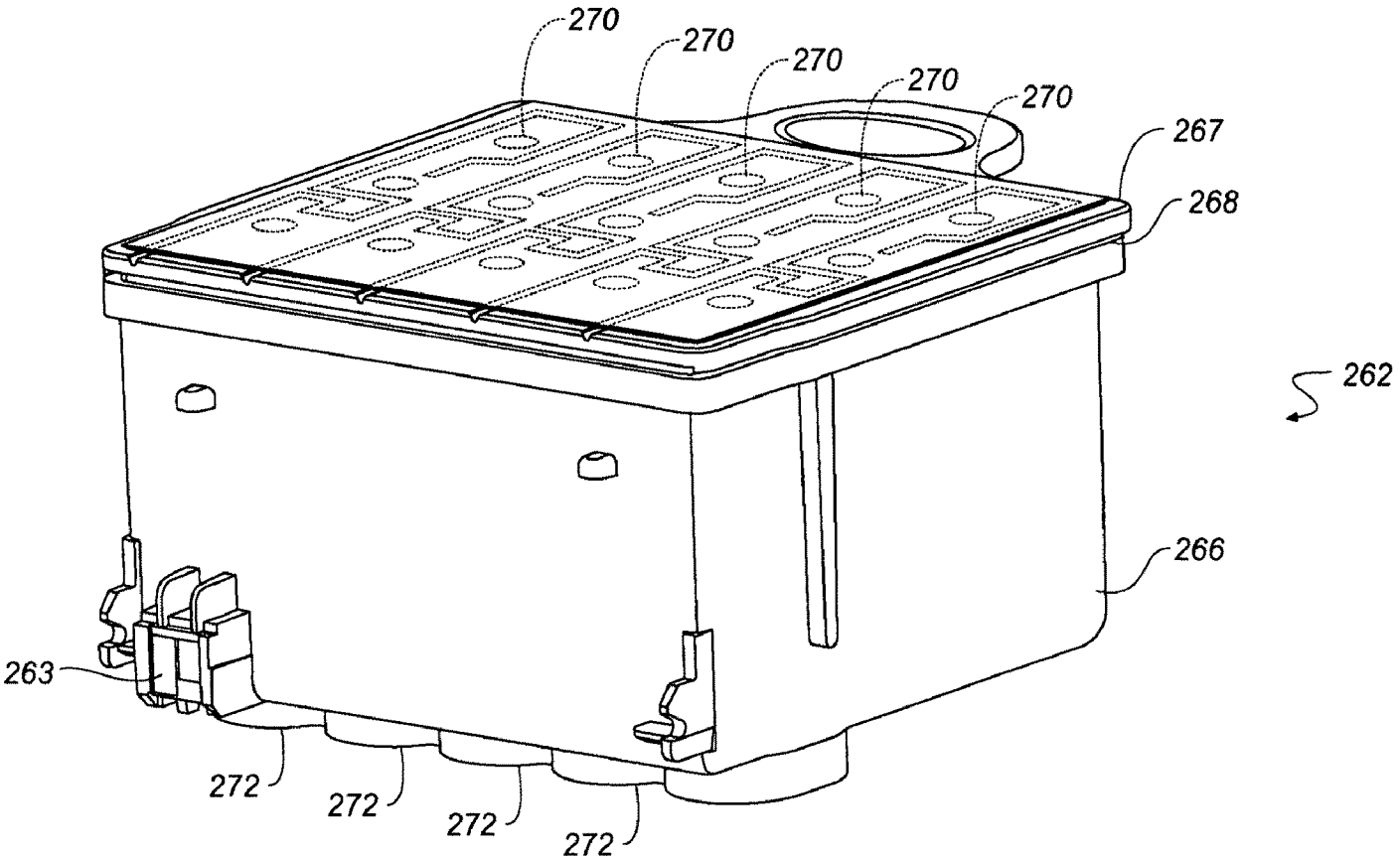
FIG. 5 is a perspective view of a multi-chamber ink tank.

One way to monitor ink remaining is to provide the controller with information about an ink fill level in an ink supply, such as an ink tank, and then have the controller track ink usage within the printer. FIG. 5 shows a perspective view of multi-chamber ink tank 262 removed from printhead chassis 250. Multi-chamber ink tank 262 includes a tank body 266 and a lid 267 that is sealed (e.g. by welding) to tank body 266 at lid sealing interface 268. Lid 267 individually seals all of the reservoirs 270 in the ink tank. In this example, multi-chamber ink tank 262 has five chambers 270 below lid 267, and each chamber has a corresponding ink tank port 272 that is used to transfer ink to the printhead die 251 (FIG. 2). As described above, the five chambers 270 could contain cyan, magenta, yellow, photo black, and colorless protective fluid, for example. Memory device 263 is programmed with information regarding the amount of ink in each chamber 270 of multi-chamber ink tank 262. When the tank is new, memory device 263 includes information programmed by the ink tank supplier. After multi-chamber ink tank 262 is installed in the printer and used, controller 14 tracks and updates the amount of ink in each chamber 270. For example, a drop counter counts the drops that are ejected during printing or maintenance by each nozzle array 253 corresponding to a particular chamber 270, and the controller multiplies the number of drops by a known drop volume for that nozzle array, in order to track ink usage. In addition, for maintenance operations such as priming, the controller multiplies the number of priming operations by a known priming volume in order to track ink usage by priming. The remaining ink amount in each chamber 270 is thus monitored and updated as ink is used by various printing and maintenance operations. Particularly for a multi-chamber ink tank it is desirable for all chambers to reach a condition of being empty at substantially the same time, because the multi-chamber ink tank 262 is no longer fully functional for printing as soon as the first ink chamber 270 is empty.

To facilitate high quality printing, some maintenance operations need to be performed on each nozzle array 253 at particular time intervals or after particular events, such as turning on the printer. For such operations, one cannot substitute doing a maintenance operation on one nozzle array 253 instead of a second nozzle array 253 in order to save ink corresponding to the second nozzle array. For example, it is typically necessary to eject a predetermined number of drops from each nozzle of a nozzle array at a predetermined time interval in order to make sure that the ink near the nozzle openings is not becoming too viscous, or otherwise nonoptimal for ejection. In such a case, for example, assuming magenta ink is low relative to cyan ink in multi-chamber ink tank 262, it is not appropriate to substitute ejection of magenta ink from the magenta nozzle array 253 with ejection of cyan ink from cyan nozzle array 253. Typically, the direct maintenance operations that are used to maintain drop quality in each nozzle array 253 cannot be substituted for one another.

Figure 6:
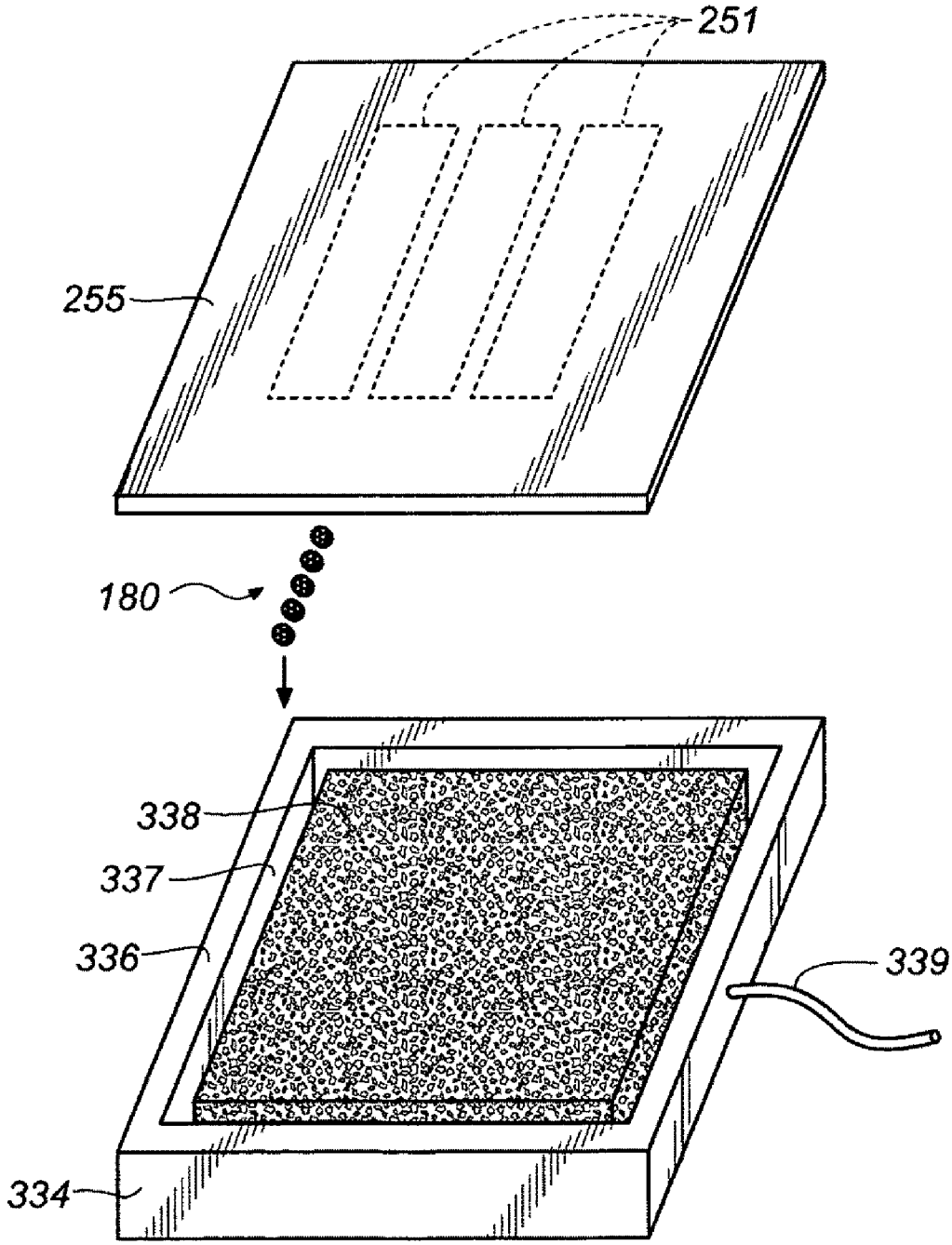
FIG. 6 is a schematic view of a portion of a printhead ejecting ink droplets into a maintenance station cap according to an embodiment of the invention.

However, for some other types of maintenance operations, typically the indirect maintenance operations (also called non-fluid-specific maintenance operations herein) where ink is used to condition a part of the printer, such as the cap 334, one type of ink can sometimes be substituted for another type of ink. FIG. 6 schematically shows a portion of a printhead and a cap 334. As in FIG. 2, three printhead die 251 are mounted on mounting substrate 255. The printhead die are positioned over cap 334. In some maintenance operations, the cap 334 and its sealing surface 336 are brought into sealing contact with the face of the mounting substrate 255 surrounding the printhead die 251. For clarity in FIG. 6, the cap 334 and the mounting substrate 255 are shown as being separated, so that the droplets 180 being ejected from the leftmost printhead die 251 are visible. Within a recess 337 of cap 334 is a porous member 338 that can absorb and distribute a quantity of ink. Waste ink tubing 339 extends from cap 334 and is typically connected to a suction pump (not shown) in order to remove excess liquid from cap 334. The suction pump also provides the suction pressure used during priming of the nozzles. For routine maintenance of the nozzle arrays on printhead die 251, droplets are ejected from each nozzle array. However, in some instances, such as an extended time interval since the last routine maintenance of each nozzle array, the humidity in the cap 334 can decrease. A humid environment within the cap is desirable, as it slows down the rate of evaporation of volatile ink components from the nozzles. Therefore, as disclosed in U.S. Pat. No. 5,404,158, droplets 180 of ink are sometimes ejected into cap 334 in order to humidify the cap 334. Such a maintenance operation is an indirect or non-fluid-specific maintenance operation. It helps the printhead to maintain good drop ejection capability by keeping an appropriate cap environment. To humidify the cap, a certain quantity of liquid is desired, but it does not matter whether the liquid comes from cyan, magenta, yellow, black or protective ink, for example. Therefore, in an embodiment of the invention, the usage of each ink (or equivalently, the amount of ink remaining in each of the chambers 270) of multi-chamber ink tank 262 (FIG. 5) is monitored, and a preferred ink source is chosen for humidifying the cap 334, based at least partly upon the monitored ink usage (or equivalently, the amount of ink remaining in the various ink chambers 270 at the time). For example, suppose that a computer program stored in the printer and run by firmware in the printer controller 14 has determined that the chamber 270 containing cyan ink has comparatively the most ink within multi-chamber ink tank 262 at a time just prior to when a timer or other monitoring or sensing device indicates that the cap 334 should be humidified. The computer program and firmware in the controller identities the cyan ink source as the preferred fluid source for use in the cap humidifying maintenance operation and causes ejection of only cyan ink droplets 180 from the cyan nozzle array (shown as residing in the leftmost printhead die 251 in the example FIG. 6) to provide the entire desired quantity of liquid required for cap humidification. At another time, depending on-usage of various inks for the user's print jobs, or depending on the amount of ink used in printhead maintenance for different nozzle arrays, perhaps a different ink source, such as protective ink would have the most ink remaining when the cap humidification operation is required. In such a case, rather than using cyan ink to humidify the cap 334, the protective ink source would be identified by the controller 14 as the preferred ink source to provide the entire desired quantity of liquid required for cap humidification maintenance operation.

The computer program, firmware and controller 14 can also identify a non-preferred ink source for use in such an indirect maintenance operation. For example, suppose at a given time, magenta ink has less ink remaining in multi-chamber ink tank 262 than the amount of cyan ink remaining. The controller 14 would then identify magenta ink as a non-preferred ink source and cyan ink as a preferred ink source for the maintenance operation. Cyan ink would therefore be used in a greater quantity than magenta ink for the next such indirect maintenance operation, such as cap humidification. The quantity of magenta ink used in the maintenance operation could be zero, or it could be selected to be merely a lower quantity than the amount of cyan ink used. For example, the controller could cause at least twice as many cyan drops to be used as magenta drops to humidify the cap in this example. Depending upon relative ink levels within multi-chamber ink tank 262, the controller could identify more than one preferred ink source for primary use in a given instance of an indirect maintenance operation. Similarly, the controller could identify more than one non-preferred ink source to avoid using (or to use in lesser quantities) in a given instance of an indirect maintenance operation. In other words, if C, M, Y, K and P represent the quantities of cyan, magenta, yellow, black and protective ink remaining in multi-chamber ink tank 262, and a quantity of liquid L is needed for a given instance of an indirect maintenance operation, the controller would cause the quantity of liquid L to be provided as quantities $(c+m+y+k+p)=L$, where c, m, y, k and p are the amounts of each ink used respectively in the maintenance operation. In one instance, if the remaining amount C is significantly greater than any of the other remaining amounts M, Y, K and P (and is therefore a solely preferred ink source), then the quantity of cyan ink used in the maintenance operation is $c=L$, while $m=y=k=p=0$. In another instance if Y is significantly less than any of the other amounts of remaining C, M, K and P (and is therefore a solely nonpreferred ink source), then $y=0$, and $c=m=k=p=0.25$ L, for example. In such a way, the usable life of the multi-chamber ink tank 262 can be extended because the ink source having the least amount of remaining ink reaches an empty condition at a later time, since it has been preferentially less used in non-fluid-specific maintenance operations where the type of ink used does not matter. Since the preferred and non-preferred ink sources can be selected differently throughout the life of the ink tank, adjustments to the amount of ink used in indirect maintenance operations can be iteratively made on the basis of how much of each type of ink is left.

Such a method of controlling the amount of ink used in indirect maintenance operations according to how much ink of each type is remaining can be particularly advantageous for the cases where a plurality of ink sources are replaceably installed on a printer carriage 200 (FIG. 3). This is because the total mass of ink that can be carried on the carriage is limited, in order that that carriage acceleration and deceleration do not cause excessively large forces during printer operation so that the amount of ink of each type is relatively small. Ease of use can be improved and expense of operation can be decreased if the life of the plurality of ink sources can be extended. This is true for ink tanks that are replaceably installable on a printhead, such as the example of ink tanks 262 and 264 on printhead 250. It is also true where the ink sources are integrated together with the printhead die in a replaceably installable print cartridge (not shown).

In the embodiment described above, the plurality of ink sources are all included in one multi-chamber ink tank 262, and as soon as one ink is depleted, the multi-chamber ink tank 262 must be replaced in order to continue to allow fully functional printing. In other words the plurality of ink sources are replaced all at one time. Even for the case of individually replaceable ink tanks for cyan, magenta, yellow, black, etc. inks in single chamber ink tanks like 262, the method of having multiple ink tanks becoming empty at the same time is advantageous, so that the user does not need to interrupt his printing as frequently in order to acquire and install ink tanks. Typically, when a new ink tank is installed, a priming operation is done on the nozzle face of the printhead. Such a priming operation not only uses ink from the newly installed ink tank, but from the other ink tanks as well. Thus if ink tanks are not installed at the same time, the repeated priming operations as each new tank is installed can waste ink.

In the embodiment described above, the monitoring of the usage of the ink sources was described relative to a multi-chamber ink tank 262 that was currently installed in the printer. Some users have usages of ink levels that are outside the normal ranges that ink tank suppliers use to determine the appropriate initial ink fill levels in the ink chambers. For example, a user who tends to print presentation documents having a cyan background would use cyan ink at a greater rate than is typical. Another user might tend to print images that use a lesser amount of protective ink than is typical. For a newly installed multi-chamber ink tank 262, rather than printing for awhile and then noticing that cyan is being used excessively and should be identified as the non-preferred ink source, or that protective ink is being sparsely used and should be identified as the preferred ink source for indirect maintenance operations, the computer program, firmware and controller 14 can store in memory the usage pattern based on one or more previously installed multi-chamber ink tanks 262, and identify the preferred and/or non preferred ink sources to use for indirect maintenance operations based on the historical usage patterns stored in memory.

Some printers use one or more pigmented inks and also one or more dye-based inks. In such a case, identifying a preferred fluid source for a non-fluid-specific maintenance operation can depend on more than the criterion of the monitored usage of the plurality of fluid sources. For example, a dye-based ink could be more suitable for use in a particular indirect maintenance operation. Thus, the preferred fluid source could be a dye-based ink, even though there is more of a pigment based ink remaining. In other words, there can be a first set of criteria for identifying preferred and nonpreferred dye-based inks and a second set of criteria for identifying preferred and nonpreferred pigment-based inks.

Figure 7:
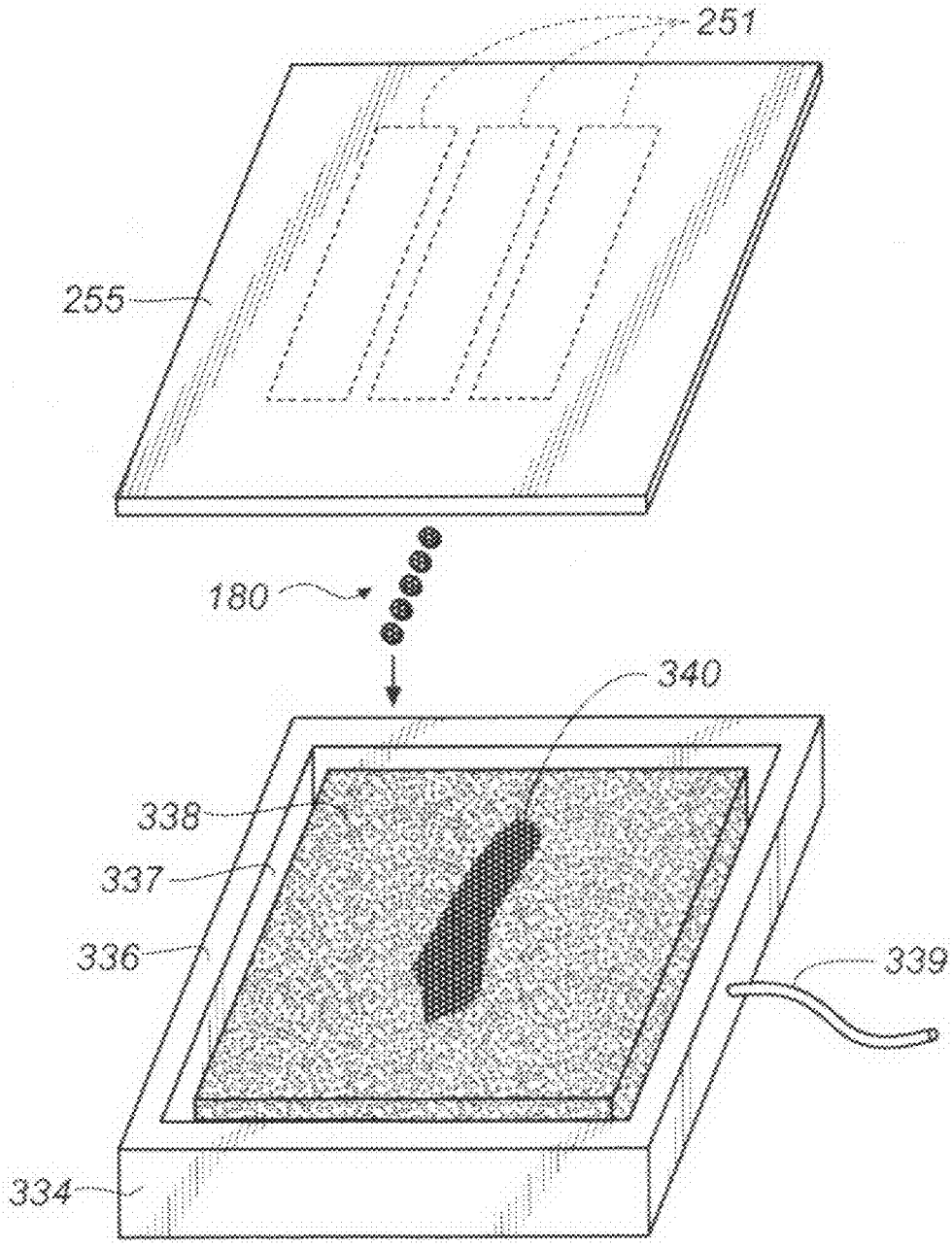
FIG. 7 is a schematic view of a portion of a printhead ejecting ink droplets onto accumulated ink residue in a maintenance station cap according to an embodiment of the invention.

Another embodiment of the invention is shown in the schematic view of FIG. 7. In this example, one of the fluid sources (for example black ink) is a pigmented ink, and a plurality of other fluid sources is dye-based inks. FIG. 7 has many of the same elements and numbering as FIG. 6. Also shown is an accumulated ink residue 340 on the porous medium 338 in cap 334. The accumulated ink residue 340 can be sludge resulting from priming and or ejecting of pigmented ink into cap 334, followed by evaporation or pumping away of the volatile liquid components of the pigmented ink. As disclosed in U.S. Pat. No. 6,722,755 such pigment ink residue can clog pores in the porous medium so that it no longer absorbs ink effectively in the region of the accumulated residue. However, as disclosed in '755, deposition of color dye ink was found to mix with the pigment ink residue and unclog the pores so that the ink could be well distributed in the absorbent porous medium. In an embodiment of the present invention, it is observed that any of several dye-based (or non-pigment-based) fluids in the printer (for example in multi-chamber ink tank 262) would be suitable for depositing onto a pigment ink residue to help free up clogged pores and inhibit further residue from building up. In a similar way that was described above with reference to the embodiment of cap humidification, the usage of the non-pigment based fluids (color dye ink and protective ink for example) could be monitored to determine an amount of ink remaining. One or more preferred fluid sources could then be identified using a computer program run by firmware with controller 14. Preferred non-pigment-based fluids would then be used in a greater quantity than non-preferred fluids to be deposited on the accumulated pigment ink residue 340 in order to loosen the residue and clear clogged pores in porous medium 338. In a similar fashion one could choose preferred and nonpreferred inks to use for loosening or cleaning accumulated ink residue in spittoon 342 and/or platen absorber 348.

In yet a further embodiment, different nozzle arrays eject droplets of different size, as described above with reference to FIG. 1. The criteria for selecting a preferred fluid to be used in a non-fluid-specific maintenance operation can depend on criteria relating not only to the monitored usage of the different fluid sources, but also relating to the magnitude of the ejected drop volume from the nozzle arrays corresponding to the different fluid sources.

Figure 8:
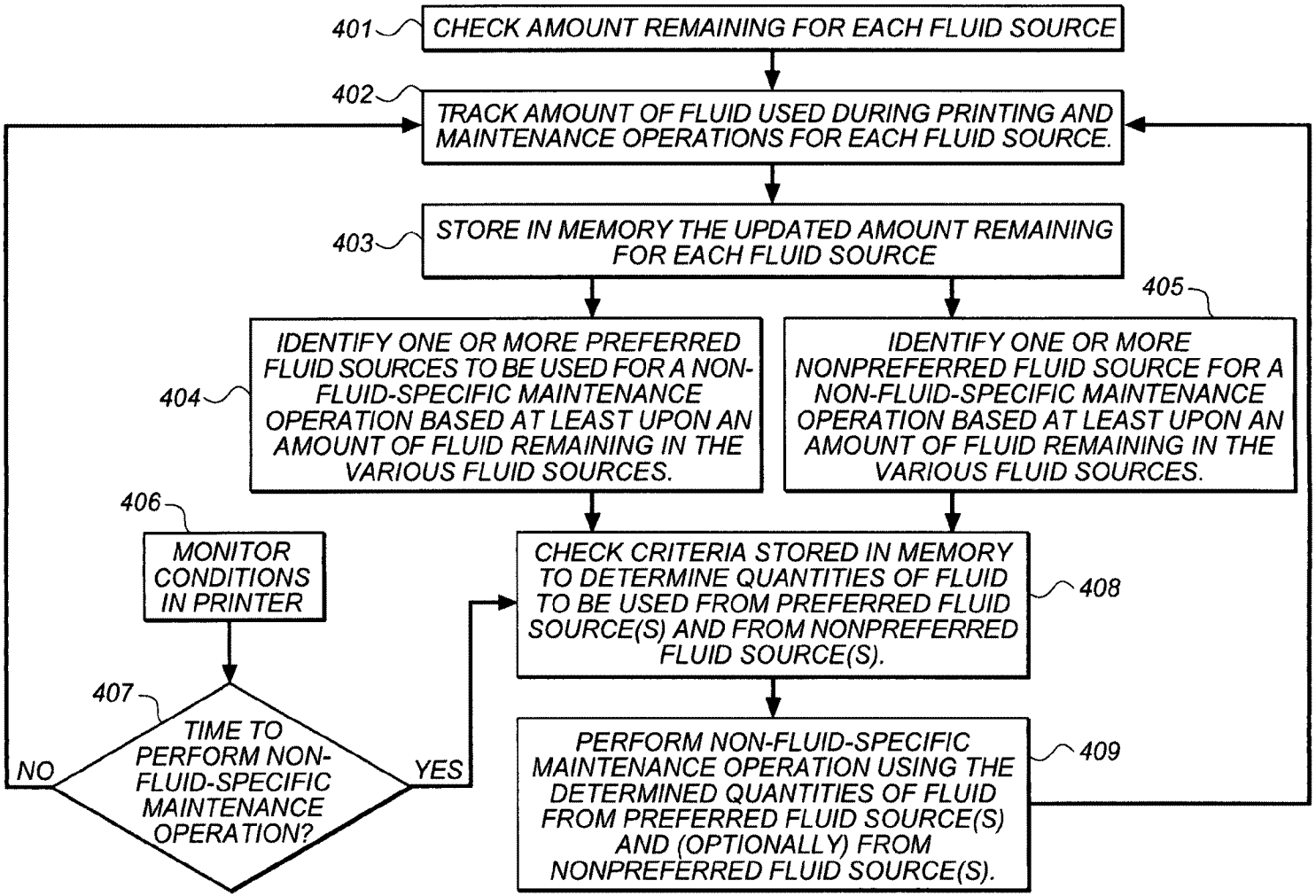
FIG. 8 is an exemplary flow chart of the steps of the method of an embodiment of present invention.

FIG. 8 shows an exemplary flow chart of steps for a computer program stored in printer memory and run in firmware in cooperation with controller 14 for a non-fluid-specific (or indirect) maintenance operation, such as cap humidification or loosening of accumulated ink residue. At step 401 the program causes the controller 14 to check the amount of ink remaining in each fluid source. At step 402 the program causes the controller to track (i.e. monitor) the amount of ink used during printing and maintenance operations for each fluid source. At step 403 the program causes the controller to store in memory an updated amount of ink remaining in each fluid source. At step 404, the program causes the controller to identify one or more preferred fluid source(s) to be used for a non-fluid-specific maintenance operation based at least upon an amount of ink remaining in the various fluid sources as stored in memory at step 403. Also at step 405 the program causes the controller to identify one or more nonpreferred fluid source(s) for a non-fluid specific maintenance operation based upon an amount of ink remaining in the various fluid sources. In parallel with these steps, at step 406 the program causes the controller to monitor conditions in the printer using sensors or timers since particular events, for example. At step 407, the program causes the controller to determine whether it is time to perform a non-fluid-specific maintenance operation based upon the monitored conditions from step 406. If it is not yet time, the program goes back to step 402. If the controller determines that it is time to perform the non-fluid-specific maintenance operation, then at step 408 the program causes the controller to check criteria stored in printer memory to determine quantities of ink to be used from preferred fluid sources) and from nonpreferred fluid source (s). Then at step 409, the program causes the controller to send instructions to perform the non-fluid-specific maintenance operation using the determined quantities of fluid from preferred fluid source(s) and (optionally) from nonpreferred fluid source(s), as determined in step 408. The program then resets to step 402 and continues to track the amount of ink used during printing and maintenance operations for each fluid source. Not explicitly shown in FIG. 8 sue the optional computer program steps relating to: a) using a first set of criteria to identify a preferred dye-based ink and a second set of criteria to identify a preferred pigment-based ink; or b) using criteria for identifying a preferred ink source that also includes the magnitude of the ejected drop volume.

In the embodiments described above, the computer program was described as being stored in printer memory and run on firmware in cooperation with controller 14. More generally, the computer program includes a computer readable storage medium having a computer program stored thereon for performing the steps of monitoring the usage of the plurality of fluid sources, identifying a preferred fluid source for use in a maintenance operation based on the monitored usage of the plurality of fluid sources, and performing the maintenance operation using a first quantity of fluid from the preferred fluid source. The terminology "computer program" does not mean that it is run from a host computer for the printer. More typically the program would be stored and run within the printer itself.

In prior inkjet printers, when a multi-chamber ink tank 262 is indicated to have one empty chamber, a signal is provided to the user to replace the multi-chamber ink tank 262, and all of the remaining ink in the non-empty chambers of that multi-chamber ink tank 262 is discarded. In still another embodiment, the computer program can instruct the controller to use all or a portion of the ink remaining in the non-empty chambers to perform a non-fluid-specific maintenance operation. For example, even if the cap is not quite due for humidification, the multi-chamber ink tank 262 that is about to be discarded can provide the ink for humidification, rather than later using ink from the replacement multi-chamber ink tank 262 to humidify the cap, thus saving even more ink in the replacement ink tank.

Furthermore, if it is projected that a pigment ink residue 340 has accumulated in the cap 334 or the spittoon 342 or the platen absorber 348, the computer program can instruct the controller to cause ejection of all or a portion of the remaining non-pigmented fluids in the non-empty chambers to soak the region of the residue to further clean or loosen the residue. Even if all of the inks having colorants are pigmented inks, the remaining nonpigmented protective ink in a multi-chamber ink tank 262 having an empty chamber can be used to loosen or clean away the ink residue 340.

In order to deposit the nonpigmented fluid(s) onto the region of the ink residue 340 in the cap 334 or spittoon 342, the controller can also cause the carriage motor 380 to move the carriage 200 such that the nonpigmented fluid(s) will be ejected onto the position of the ink residue 340. In other words, although normal direct maintenance operations would typically position the printhead such that the pigmented fluid would always deposit in the cap in a first region. Typically, in a normal direct maintenance operation, since the nozzle arrays 253 (see FIG. 2) are displaced laterally from each other, the nonpigmented fluids would typically deposit in a region that is offset from the ink residue. In addition to positioning the carriage 200 such that the non-pigmented fluid is ejected onto the ink residue, the controller 14 can also cause the carriage motor 380 to scan back and firth somewhat during ejection of nonpigmented ink in order to ensure coverage over the width where ink residue 340 may have accumulated.

The controller can also track the number of maintenance events that would have deposited ink residue 340 at different locations in the cap 334, the spittoon 340 and the platen absorber 348 in order to prioritize how much of the remaining nonpigmented fluid should be deposited where. For example, the controller could track the number of borderless prints on different sized media have been done, so that it could be projected how much ink residue 340 is present where, and how much of the remaining nonpigmented ink should be deposited near the position of the edges of those sizes of media.

The controller can also track the amount of elapsed time since various depositions of pigmented ink and prioritize the timing of depositing the nonpigmented inks in those locations while the ink residue 340 is still somewhat moist so that it is more readily cleaned by the deposition of nonpigmented inks.

The amount of time it could take to empty remaining ink to clean or loosen an ink residue 340 depends on the amount of ink remaining after the first chamber is substantially empty. Suppose ter example, that there is 1 ml of protective ink remaining after the controller detects that a chamber is substantially empty. If there are 640 nozzles in the nozzle array for protective ink, and the drop ejection is 6 pl per drop at a frequency of 25 kHz, then the 1 ml could be emptied in about 10 seconds. All or a portion of this amount could be deposited at ink residue sites in the cap 334, the spittoon 342 or along the platen absorber 348. Optionally, the total amount of ink used from the non-empty chamber(s) could be used as a final step before instructing the user to replace the ink tank, or it could be done in a few shorter operations as the one or more partially empty chambers approach depletion, so that the final indirect maintenance step would not seem to take as long.

Before the multi-chamber ink tank 262 has one substantially empty chamber, the computer program can cause the controller to provide the user with a warning message when a chamber has reached a predetermined low ink level, that a new multi-chamber ink tank 262 should be acquired. Then after further usage to the point of the chamber being substantially empty, the computer program would instruct the controller to use all or a portion of one or more of the remaining inks to perform one or more non-fluid-specific maintenance operations. Finally, the computer program would instruct the controller to provide a message to the user that a new tank needs to be installed.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)

132 Ink delivery pathway (for second nozzle array)
180 Droplets
181 Droplet(s) (ejected from first nozzle array)
182 Droplet(s) (ejected from second nozzle array)
200 Carriage
250 Printhead chassis
251 Printhead die
253 Nozzle array
254 Nozzle array direction
255 Mounting substrate
256 Encapsulant
257 Flex circuit
258 Connector board
262 Multi-chamber ink tank
263 Memory device
264 Single-chamber ink tank
266 Tank body
267 Lid
268 Lid sealing interface
270 Ink chamber
272 Ink tank port
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
332 Wiper
334 Cap
336 Sealing surface
337 Recess
338 Porous medium
339 Waste ink tubing
342 Spittoon
344 Platen
346 Platen ribs
348 Platen absorber
370 Stack of media
371 Top piece of medium
380 Carriage motor
382 Carriage guide rail
383 Encoder fence
384 Belt
390 Printer electronics board
392 Cable connectors

The invention claimed is:

1. A method of controlling maintenance in an inkjet printer supplied with fluid from a plurality of fluid sources including at least a first ink having a first color and a second ink having a second color different from the first color, the method comprising the steps of:

a) determining an amount remaining for each of the plurality of fluid sources;

b) selecting one or more of the first or second inks as a preferred fluid source for a maintenance operation in which the preferred fluid source is selected according to an amount of remaining ink that is independent of ink color; and c) performing the maintenance operation using a first quantity of fluid from the preferred fluid source.

2. The method according to claim 1 further comprising the step of identifying a non-preferred fluid source for use in the maintenance operation and providing a second quantity of fluid from the nonpreferred fluid source, wherein the first quantity is greater than the second quantity.

3. The method according to claim 2, wherein the step of performing the maintenance operation further comprises ejecting at least twice as many droplets from the preferred fluid source as from the nonpreferred fluid source.

4. The method according to claim 2, wherein more than one nonpreferred fluid source is identified in the identifying step.

5. The method according to claim 1 further comprising the step of providing a cap onto which ejected ink droplets from the printhead are deposited to increase a humidity level within the cap.

6. The method according to claim 1, wherein at a first time a first fluid source is the preferred fluid source, and wherein at a second time a second fluid source is the preferred fluid source.

7. The method according to claim 1, wherein the plurality of fluid sources are replaceably installed in the printer.

8. The method according to claim 7, wherein the plurality of fluid sources must be replaced at the same time.

9. The method according to claim 7, wherein the plurality of fluid sources can be replaced individually.

10. The method according to claim 1, wherein the step of determining an amount remaining for the plurality of fluid sources includes monitoring the usage in a currently installed plurality of fluid sources.

11. The method according to claim 1, wherein the step of determining an amount remaining for the plurality of fluid sources includes monitoring the usage in a previously installed plurality of fluid sources, and wherein the step of identifying a preferred fluid source for use in a maintenance operation is based at least upon the monitored usage of the previously installed plurality of fluid sources.

12. A computer program product used in a printer system for controlling the maintenance of an inkjet printer supplied with fluid from a plurality of fluid sources including a first ink having a first color and a second ink having a second color different from the first color, the computer program product comprising: a computer readable storage medium having a computer program stored thereon for performing the steps of:

a) monitoring the usage of the plurality of fluid sources;

b) selecting one or more of the first ink or the second ink as a preferred fluid source for use in a maintenance operation in which the preferred fluid source is selected according to monitored usage of the plurality of fluid sources that is independent of ink color; and c) performing the maintenance operation using a first quantity of fluid from the preferred fluid source.

13. The computer program product as in claim 12 further comprising the step of identifying a non-preferred fluid source for use in the maintenance operation and providing a second quantity of fluid from the non-preferred fluid source, wherein the first quantity is greater than the second quantity.

14. The computer program product as in claim 13 further comprising the step of identifying more than one non-preferred fluid source.

15. The computer program product as in claim 12 further comprising the step of identifying at a first time a first fluid source as the preferred fluid source, and identifying at a second time a second fluid source as the preferred fluid source.

16. The computer program product as in claim 12, wherein the step of monitoring the usage of the plurality of fluid sources includes monitoring the usage in a previously installed plurality of fluid sources, and wherein the step of identifying a preferred fluid source for use in a maintenance operation is based upon the monitored usage of the previously installed plurality of fluid sources.

17. The computer program product as in claim 12 further comprising the step of identifying more than one preferred fluid source.

18. An inkjet printer comprising:

a computer program product for controlling the maintenance of the inkjet printer supplied with fluid from a plurality of fluid sources including a first ink having a first color and a second ink having a second color different from the first color, the computer program product comprising: a computer readable storage medium having a computer program stored thereon for performing the steps of:

a) determining an amount remaining for each of the plurality of fluid sources;

b) selecting one or more of the first or second inks as a preferred fluid source for a maintenance operation in which the preferred fluid source is selected according to an amount of remaining ink that is independent of ink color; and c) performing the maintenance operation using a first quantity of fluid from the preferred fluid source.

19. The inkjet printer as in claim 18, wherein the computer program product further comprises the step of identifying a non-preferred fluid source for use in the maintenance operation and providing a second quantity of fluid from the non-preferred fluid source, wherein the first quantity is greater than the second quantity.

20. The inkjet printer as in claim 18, wherein the computer program product further comprises the step of identifying at a first time a first fluid source as the preferred fluid source, and identifying at a second time a second fluid source as the preferred fluid source.

21. A method of operating an inkjet printer including a plurality of ink sources including a first ink having a first color and a second ink having a second color different from the first color, the method comprising:

a) monitoring the usage of the plurality of ink sources;

b) selecting one or more of the first ink or second ink as a preferred ink source for use in a maintenance operation in which the preferred fluid source is selected according to the monitored usage of the plurality on ink sources that is independent of ink color;

c) performing the maintenance operation using a first quantity of ink from the preferred ink source; and d) controlling the printer to print an image with the plurality of ink sources.

22. The method according to claim 21, wherein the plurality of ink sources include at least one dye-based ink and at least one pigment-based ink, wherein the identifying step further includes a first set of criteria for the dye-based ink and a second set of criteria for the pigment-based ink.

23. The method according to claim 21, a first ink source corresponding to a first ejected drop volume having a first magnitude, and a second ink source corresponding to a second ejected drop volume having a second magnitude, wherein the identifying step further includes criteria relating to the magnitude of the ejected drop volume.

24. The method according to claim 21, one or more of the ink sources being a first type of ink and more than one of the ink sources being a second type of ink, wherein the identifying step further comprises identifying a preferred fluid source of the second type of ink to be deposited on an accumulated residue of the first type of ink.

* * * * *